United States Patent [19]

Bowling

[11] 4,037,662

[45] July 26, 1977

[54] AUTOMATED BAILING APPARATUS IN FLEXIBLE COMBINATION FOR BAILING SHALLOW WELLS

[76] Inventor: Leslie Bowling, 1228 First National Bank of Commerce Bldg., New Orleans, La. 70112

[21] Appl. No.: 718,495

[22] Filed: Aug. 30, 1976

[51] Int. Cl.[2] ..... E21B 37/00; E21B 27/00

[52] U.S. Cl. ..... 166/311; 166/75 R; 166/168; 175/209

[58] Field of Search ..... 166/314, 311, 75, 168; 294/68–73; 173/87; 175/209–211

[56] References Cited

U.S. PATENT DOCUMENTS

| | | | |
|---|---|---|---|
| 952,393 | 3/1910 | Whitehill | 294/72 |
| 3,190,375 | 6/1965 | Pearson | 175/209 |
| 3,938,595 | 2/1976 | Swenson | 173/87 |
| 3,952,858 | 4/1976 | Watts | 175/209 |

*Primary Examiner*—James A. Leppink
*Attorney, Agent, or Firm*—James B. Lake, Jr.

[57] ABSTRACT

On a portable frame skid base, a receiving tank is mountable and centered to engage therein a production casing of a well to be bailed. A sectional frame hoisting tower is mountable over the tank for suspending a pipe bailer therein and in alignment with the production casing. The bailer is bottom operated by means of a ball valve and downwardly extending 'stinger' in frictional cooperation with engaging rolls mounted in the tower. A wire line drum has an adjustable flange for the proper spooling of a range of sizes of wire line connected to bailer. An electric motor and reduction gear is mountable on the skid base adjacent the drum for driving it in reversible rotation as directed by automated motor controls and safety controls operable by mechanical feedback from drum and apparatus to continuously or intermittently bail a well in accordance with establishable parameters, and to shut it down in case of malfunction. The tank and tower can be enclosed to make them gas-proof for use with gassy wells, and lined with non-corroding material for use with sour wells.

7 Claims, 7 Drawing Figures

AUTOMATED BAILING APPARATUS IN FLEXIBLE COMBINATION FOR BAILING SHALLOW WELLS

BACKGROUND OF THE INVENTION

The invention relates generally to liquid bailers and more particularly to portable bailing apparatus, flexibly adjustable for meeting a range of parameters common to shallow wells, and automated to bail for regular limited periods and continuously and to cut off in case of malfunction.

Prior fluid lifting apparatus comprised pumps at the bottoms of wells for pumping the well in stages, and various means for reducing the viscosity of the contents of wells by introducing emulsifying agents to produce oil and water emulsions, and circulating an oil of low viscosity into the well to dilute the contents and make them easier to pump. Also an endless absorbent means was run on pulleys down a well for absorbing some of the contents and up for wringing the absorbent means out in a continuous operation. Reference is made to U.S. Pat. Nos: H. M. Rhodes 3,774,685; C. D. McAuliffe et al. 3,380,531 and 3,467,195; R. H. Staley 528,449; H. F. Waite 516,713; and R. P. Wilkinson 2,988,998.

SUMMARY OF THE INVENTION

It is an object of the invention to provide a bailing apparatus that is adaptable to the operating parameters of shallow wells.

Another object of the invention is to provide automated control and safety for continuous and intermittent bailing and shut-down in case of malfunction.

A further object of the invention is to provide a bailing apparatus for gassy and sour wells.

Another object is to provide a pipe bail that is lowered, raised and discharged on a common vertical axis while remaining at least partially engaged in the bailed well.

DETAILED DESCRIPTION OF THE INVENTION

Figures 1, 1A:
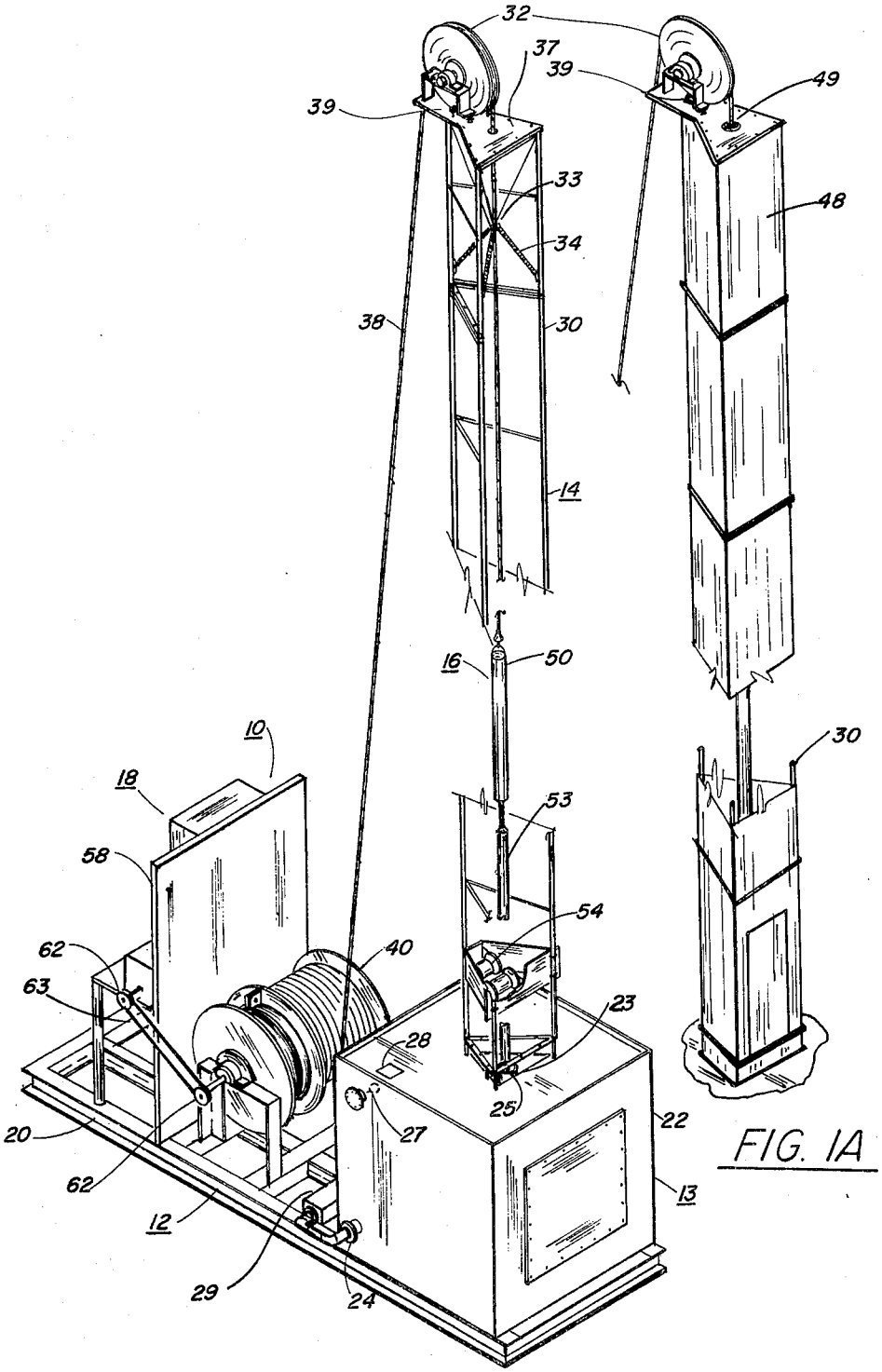
FIG. 1 is a three dimensional view of the bailing apparatus of the invention.
FIG. 1A is a three dimensional view of a gas-tight enclosure for a shallow well.
Figure 2:
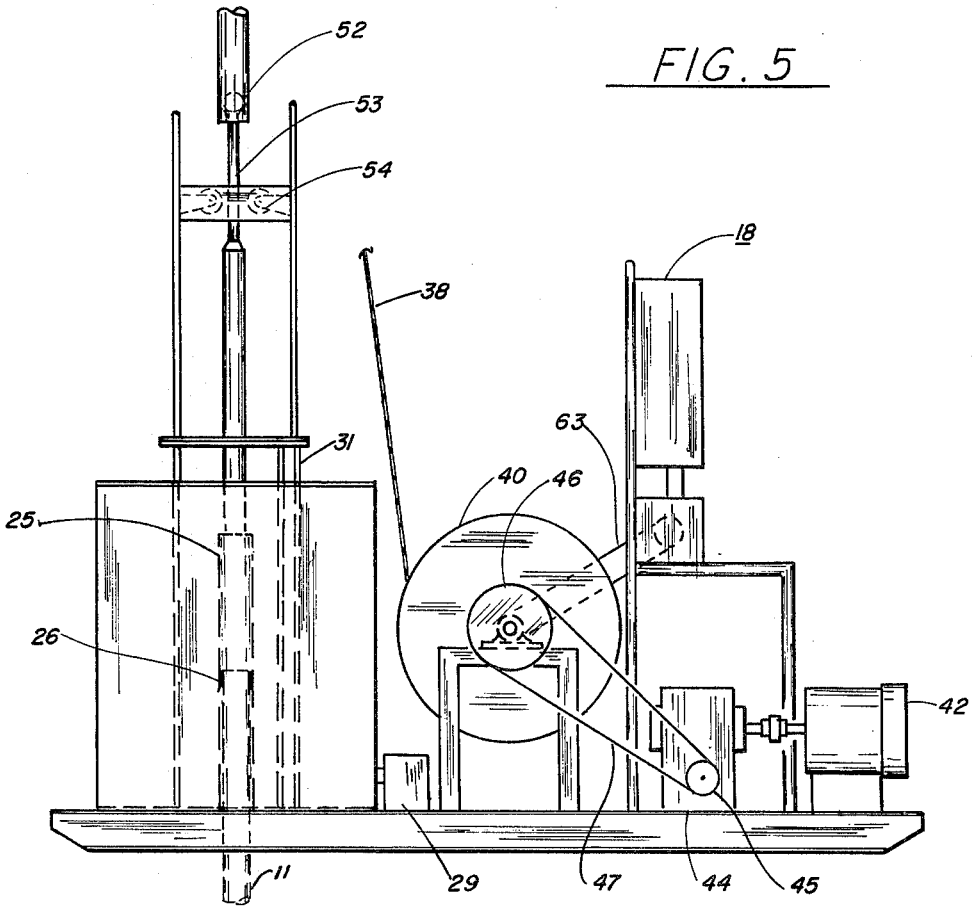
FIG. 2 is a side elevation of the bailing apparatus of the far side of FIG. 1.

Referring to FIGS. 1 and 2, the invention, bailing apparatus 10, for use over and around a shallow well head 11 comprises a frame base 12, a tank assembly 13 demountably secured to the base over said well head, hoisting tackle 14 mounted in and over the tank assembly and on base 12 adjacent thereto, a bailer 16 suspended over well head 11 and tank assembly by said hoisting tackle for passing therethrough, and control assembly 18 including safety provisions for the continuous and intermittent operation of said bailer in well head 11 by hoisting tackel 14.

Frame base 12 is an elongated rectangular framework on which are mounted all parts of bailing apparatus 10 necessary for bailing a shallow well, that is one up to about 2500 feet deep. All that is required in addition is a source of electrical power and such auxiliary means as are necessary to receive more production than tank assembly 13 can hold.

Tank assembly 13 comprises a tank 22 defining a top opening 23, a low side discharge opening 24, and a bottom opening aligned with said filling opening and through which an interior sleeve 25 extends. The sleeve is adapted to fit over a production casing 26 of well 11, and the annular space therebetween is packed off fluid tight. The sleeve and production casing extend into tank 22, the sleeve just short of top opening 23 and the production casing concentrically below that. A liquid float switch 27 is mounted near the top of tank 22 and a power cut-off switch 28 between said float switch and the top of the tank. Switch 27 activates an electric pump 29 connected to side discharge opening 24 for discharging the contents of tank 22 before danger of overflow to whatever facilities (not shown) are provided. Power cut-off switch 28 is opened in case of a malfunction of either pump 29 or switch 27.

Figure 5:
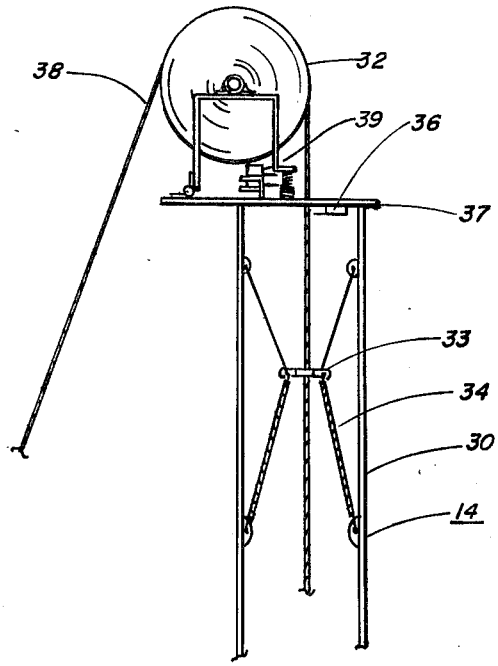
FIG. 5 is a perspective view of tower top safety devices and tower top enlarged to show detail.
Figure 4:
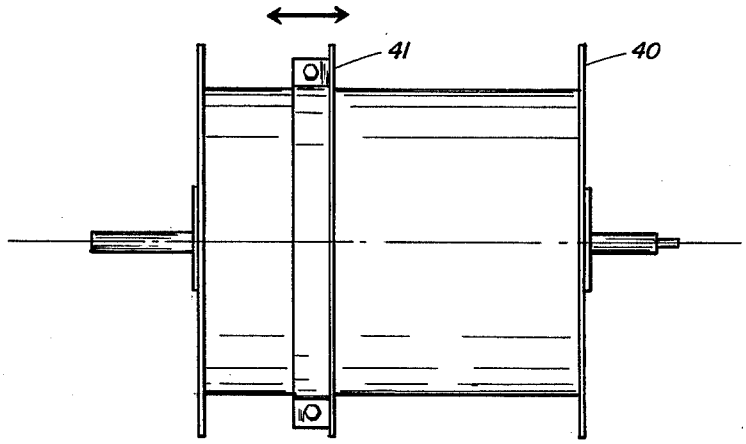
FIG. 4 is a side elevation of a drum with adjustable flange.

Referring additionally to FIGS. 1A, 4 and 5, hoisting tackle 14 comprises a tower 30 having a plurality of joinable sections of which a bottom section 31 is fixed to the bottom of tank 22 and extends therethrough to above said tank thereby assuring alignment of production casing 26 with tower 30. Additional sections can be added to the base as needed. A crown block 32 is pivotally mounted on top of tower 30, and therebelow, a safety control stop 33 (see FIG. 5) is suspended therefrom and tethered from below by several springs 34 fastened to tower 30. Lines 35 are threaded through springs 34 to limit spring extension and prevent control stop 33 from being pulled through crown block 32. A safety switch 36 is mounted under top 37 of tower 30 and is opened by contact with stop 33 to shut off power. A strain switch 39 is double spring mounted between tower top 37 and crown block 32 over which a line 38 is led from a drum or windlass 40 to a part of bailer 16, said switch being operated by a strain on said line to cut off power to bailing apparatus 10 when the strain is less than and more than predetermined limits, that is less than approximately 500 lbs. and more than 2500 lbs. Line 38 is spooled on drum 40 that is mounted for rotation on frame base 12 adjacent tank 22 and tower 30, said drum having an adjustable flange for spooling an exact number of turns of the possible sizes of suitable lines. An electric motor 42, connected to a reduction gear 44 drives drum 40 by means of pulleys 45 and 46 and a connecting drive chain or belt 47. As shown in FIG. 1A, tower 30 and tank 22 can be made gas tight by closures 48 and a stuffing box 49 for the line from the crown block to run through.

Figure 6:
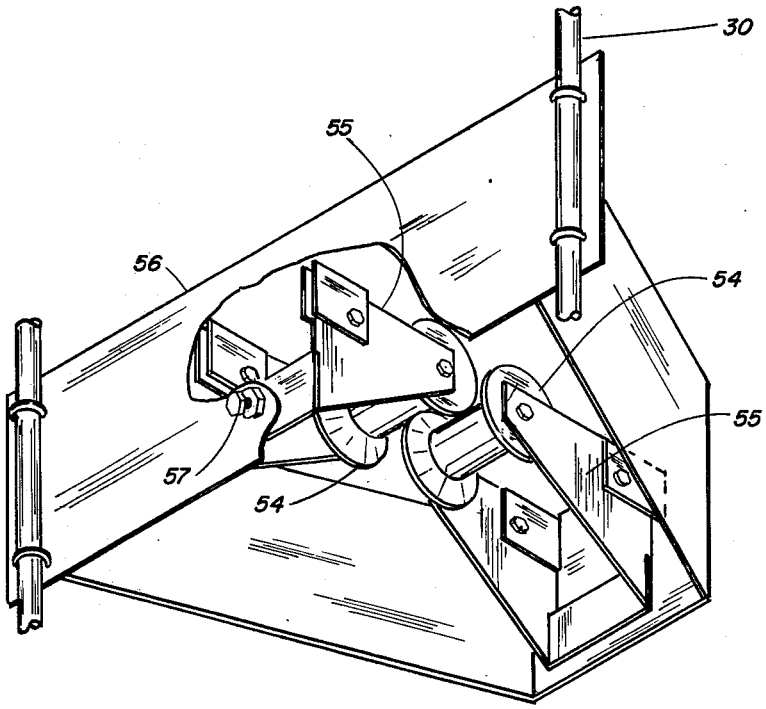
FIG. 6 is a three dimensional view a valve tripping roller device for tripping a bailer valve.

Referring additionally to FIG. 6, bailer 16 comprises a pipe bail 50, having a bottom ball valve 52 with an attached "stinger" 53, suspended in tower 30 by lines 38, and friction rolls 54 rotationally mounted in brackets 55 that are pivoted between projections of brackets 56 mounted in tower 30. Pipe bail 50 is lifted clear of tank 22 by hoisting tackle 14 with stinger 53 remaining engaged in the upper portion of sleeve 25 and between friction rolls 54. As bail 50 starts downward, friction rolls 54, limited by set screws 57, pivot to engage said stinger to open bottom ball valve 52 and dump said bail's contents into tank 22. Continuing downward in production casing 26, said valve is opened by the bail striking the surface of the well's contents or its bottom to refill said bail. Valve 52 is closed by gravity as the bail starts upward until opened by said friction rolls as aforesaid. In its passage upward bail 50 passes through rolls 54 which pivot upward to allow it to pass.

Figure 3:
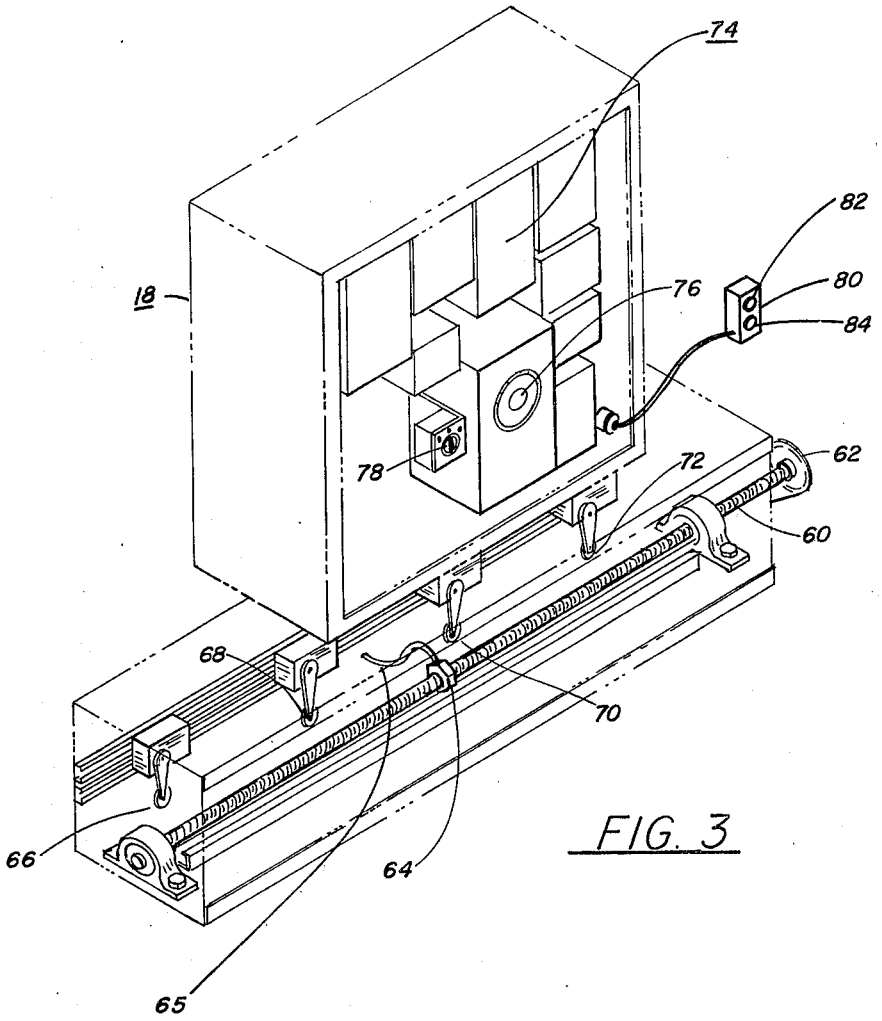
FIG. 3 is a three dimensional view and block diagram of the automated controls.
Figure 7:
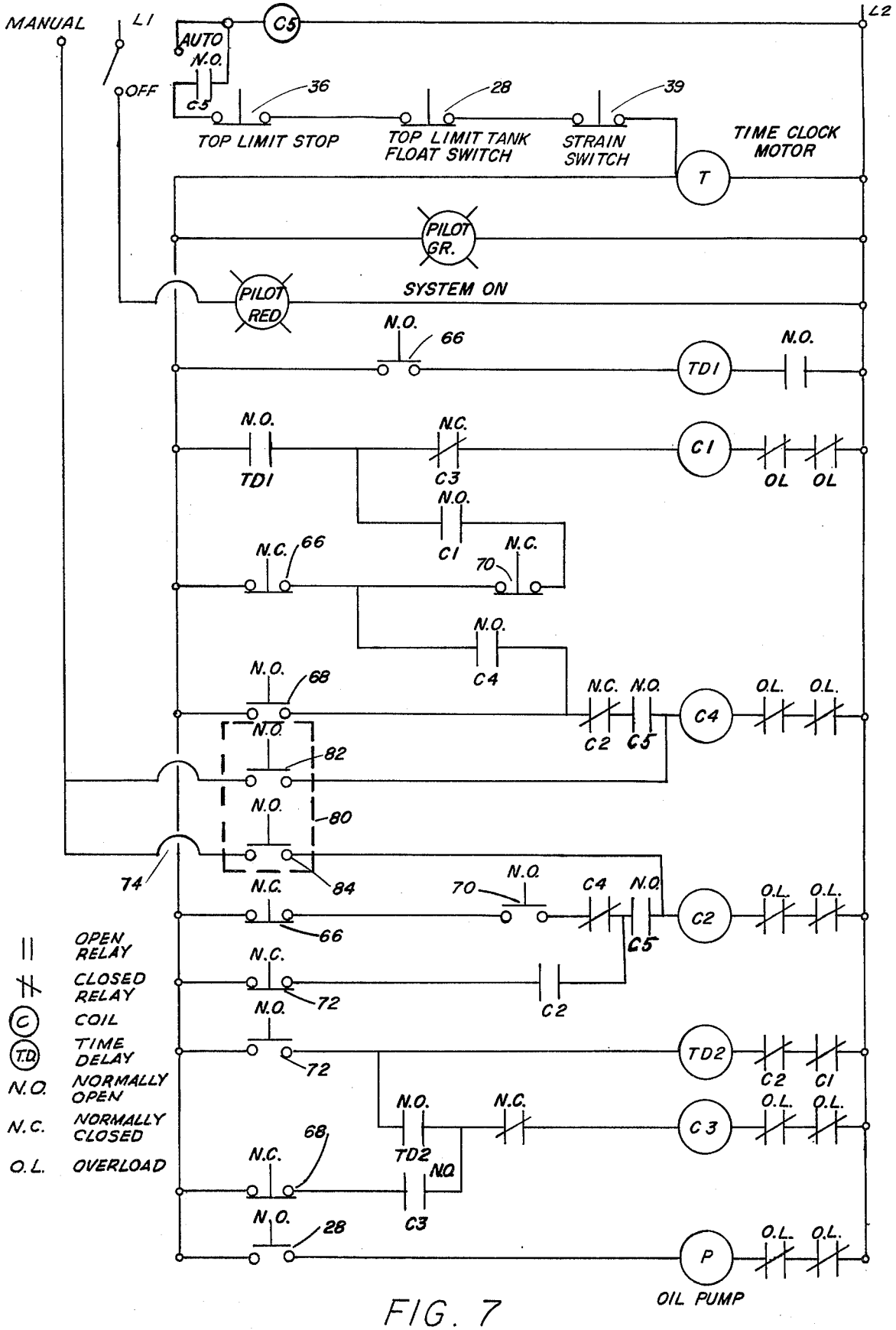
FIG. 7 is a diagrammatic sketch of the electrical circuit of the invention.

Referring additionally to FIGS. 3 and 7, the control and safety assembly 18 comprises a consol 58 in which is mounted for rotation a threaded rod 60 which is driven by pulleys 62 connected by a second drive belt 63 from drum 40. A traveling pawl or nut 64 is mounted on said threaded rod to travel from one end to the other dependent on the direction of rotation. An arm 65, fixed to pawl 64 engages in its travel a line of limit switches 66, 68, 70, and 72 in succession. The switches are adapted to energize electric motor 42 as follows; switch 66 lowers bail 50 at top speed past switch 68 for switch 70 to cut downward speed by half and for switch 72 to stop and after a time interval to raise bail 50 at top speed past switch 70 for switch 68 to cut up speed by half and for switch 66 to stop and after said time interval to repeat the routine as stated. The control switches are connected with limit relays 74 as shown in FIG. 7 and with a timer 76 for setting any time period for operation of the bailing operation unless stopped by safety control switches 28, 36 and 39 as hereinbefore described. A master bailing apparatus switch 78 is provided for setting the apparatus for automatic or manual operation and for turning it on and off. A manual switch 80 controls bail 50 hoisting at half speed only.

The invention in its combination of a bottom discharge pipe bailer, the alignment of a production casing with a receiving tank and the bailer and a hoisting tower makes possible an efficient and cheap bailing apparatus for automated repetitious operation for any period of time or plurality of discrete periods. The apparatus is easily conformed in a flexible structure and mode of functioning to the parameters of most shallow wells in amount of liquid bailed per unit trip and/or period of time by changing length of pipe bailer, number of segments in hoisting tower, size of wire line, position of movable windlass flange, ratio of respective pairs of drive pulleys, and positions of limit switches. And more drastically a drive motor and operating accessories, windlass working radius, and receiving tank can be replaced with other sizes, either separately or in any combination.

What is claimed is:

1. In an automated bailing apparatus, flexible in ranges of sizes of structure and material, and adjustable in operating parameters, for bailing shallow wells comprising in combination:

a. portable base means for installing over and around a shallow well production casing end extending above ground and said portable base means;

b. stationary tank assembly means, having sides, an enclosed top defining an opening, and a closed bottom defining a sleeved hole extending upwardly therein and in alignment with said top opening, mountable on said base means and adapted to receive in said sleeved hole said production casing end, fluid tight;

c. hoisting tackle means having in combination a hoisting tower with hoisting line mounted in and over said tank assembly means and in alignment with said top opening, and a drum or windlass mounted on said base means adjacent said tank assembly means, for raising and lowering a free end of said hoisting line through said aligned top opening and into said tank assembly means and shallow well production casing:

d. bailer means secured to the free end of said line of the hoisting tackle means for raising liquid from said shallow well and discharging it above and into said tank assembly means; and e. control assembly means, having operating control means for actuating said hoisting tackle means and bailer means to travel full speed for a part of each trip from bottom of said shallow well to above said tank assembly means and return and half speed for a predetermined distance as the respective extremities of travel are approached, and adjustable to automatically bail any shallow well continuously for any period, depth, and desirable range of rates of bailing, and safety control means for cutting-off power in case of malfunction, separately or together, of any of the preceeding means.

2. An automated bailing apparatus as described in claim 1 wherein said tank assembly means comprises:

a. a tank having a bottom, and sides defining a discharge hole in a side adjacent said bottom; and b. a liquid pump mounted on said portable base means adjacent said tank and connected to said discharge orifice for evacuating the tank, said pump being actuated by a tank float switch.

3. An automated bailing apparatus as described in claim 1 wherein said hoisting tackle means comprises:

a. said hoisting tower has a bottom section fixed in said tank assembly means to extend thereabove, in alignment with said top opening and additional tower sections mounted sequentially thereon as desired;

b. A crown block mounted at the top of said hoisting tower and adapted to suspend said hoisting line in alignment with said tower and top opening, and bottom sleeved opening of said tank assembly means;

c. a mechanical safety stop suspended from said tower and adjacent said top of tower and thethered therein by line restrained springs for preventing bailer means attached to said hoisting line from being pulled through said crown block;

d. and said drum or windlass having an axially adjustable peripheral flange for evenly spooling a plurality of sizes of hoisting line, said windlass or drum being adapted to spool said hoisting line over said crownblock down said tower and in and out of the tank assembly means and production casing extending therein; and e. reversible power means operably connected to said drum or windlass for rotating said drum in both directions of rotation to spool said hoisting line thereon and off directly and without clutch and brake, said power means being mounted on said portable base means adjacent said windlass or drum.

4. A hoisting tower as described in claim 3 wherein said tower sections above said tank assembly means have enclosed sides and a stuffing box mounted at the tower top through which said hoisting line extends for gas proofing said tower.

5. A tower as described in claim 4 wherein the interior of said tower is glassed for use with acid or "sour" wells.

6. An automated bailing apparatus as described in claim 1 wherein said bailer means comprises:

a. a pipe bail having a bottom valve operable to open by fluid flow and close by gravity, and having a downwardly extending rod or "stinger" fixed thereto for additionally opening the bottom valve; and b. friction rolls mounted over said top opening in said tank assembly means and adapted to frictionally receive said downwardly extending rod or stinger therebetween, said rolls being pivotally mounted to pivot away from each other to allow said pipe bailer to pass therebetween, and to pivot toward each other to engage said rod or stinger for opening the bottom valve of said pipe bailer and dump the contents into said tank assembly means.

7. An automated bailing apparatus as described in claim 1 wherein said safety control means comprise:

a. a normally closed overflow switch means mounted in and adjacent to the top of said tank assembly means and responsive to a rise of the contents therein short of overflow to open, said overflow switch being connected in series across power lines to said operating control means for stopping bailing operation before tank overflow;

b. a normally closed strain switch mounted in said hoisting tackle means and responsive to a minimum and a maximum loads thereon to open, said strain switch being connected in series with said overflow switch across said power lines; and c. a normally closed top limit switch mounted in said hoisting tackle means and responsive to an excessive raising of said bailer means to open, said switch being connected in series with said overflow and strain switches across said power lines.

8. An automated bailing apparatus as described in claim 1 wherein said operating control means comprises:

a. a threaded rod mounted for rotation by said windlass or drum in both directions of rotation;

b. a traveling nut having threads complementary to the threads of said threaded rod and adapted to travel thereon in synchronization with said bailer means as it travels in bailing and as said threaded rod is rotated;

c. an arm, adapted to operate limit switches, fixed to said traveling nut;

d. a plurality of limit switches adapted to start, stop, reverse and slow said windlass or drum adjustably mounted along a line of travel of said traveling nut and arm and to be engaged thereby to automate the control of said hoisting tackle means and bailing means in bailing operation.

9. Method of bailing a shallow well comprising the steps of:

a. concentrically ensleeving with an open ended sleeve an upper end of a well production casing of a shallow well in a fluid tight receiving tank having a top opening in alignment said production casing and sleeve;

b. suspending for vertical movement from a tower in alignment with said tank opening and sleeve, a pipe bail having a downward projection stinger that is adapted to remain, at least partially, in said well production casing;

c. initially actuating said vertical movement by hand switch;

d. continuing said vertical motion in bailing operation by mechanical feed back to automatically actuate limit switches that are positioned synchronously with respect to said bailing operation to continue it; and e. actuating said stinger to empty by engaging between friction rolls mounted above said tank, said rolls being pivoted to swing upward apart and downward closer for frictionally engaging said stinger to empty said bailer.

* * * * *